US007520598B2

(12) United States Patent
Xu et al.

(10) Patent No.: US 7,520,598 B2
(45) Date of Patent: Apr. 21, 2009

(54) PRINTER DEFLECTOR MECHANISM INCLUDING LIQUID FLOW

(75) Inventors: Jinquan Xu, Rochester, NY (US); Zhanjun Gao, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/746,094

(22) Filed: May 9, 2007

(65) Prior Publication Data

US 2008/0278549 A1 Nov. 13, 2008

(51) Int. Cl.
*B41J 2/09* (2006.01)

(52) U.S. Cl. ..... 347/77

(58) Field of Classification Search ..... 347/76, 347/77, 75, 74, 73, 72, 78, 79, 80, 81, 82, 347/9

See application file for complete search history.

(56) References Cited

U.S. PATENT DOCUMENTS 4,068,241 A 1/1978 Yamada
6,457,807 B1 10/2002 Hawkins et al.
6,491,362 B1 12/2002 Jeanmairc
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,588,889 B2 * 7/2003 Jeanmaire ..... 347/77

* cited by examiner

*Primary Examiner*—K. Feggins
(74) *Attorney, Agent, or Firm*—William R. Zimmerli

(57) ABSTRACT

A printing system includes a liquid drop ejector operable to eject liquid drops having a plurality of volumes along a first path and a passage including a wall. A gas flow source is operable to cause a gas to flow in a direction through the passage. A liquid flow source is operable to cause a liquid to flow in a direction along the wall of the passage with the flow direction of the liquid being in the same direction as that of the gas flow. Interaction of the gas flow and the liquid drops causes liquids drops having one of the plurality of volumes to begin moving along a second path.

27 Claims, 6 Drawing Sheets

PRINTER DEFLECTOR MECHANISM INCLUDING LIQUID FLOW

CROSS REFERENCE TO RELATED APPLICATIONS

Reference is made to commonly-assigned, U.S. patent application Ser. No. 11/746,117, filed currently herewith, entitled "A FLUID FLOW DEVICE AND PRINTING SYSTEM," and U.S. patent application Ser. No. 11/746,104, filed currently herewith, entitled "A FLUID FLOW DEVICE FOR A PRINTING SYSTEM."

FIELD OF THE INVENTION

This invention relates generally to the management of gas flow and, in particular to the management of gas flow in printing systems.

BACKGROUND OF THE INVENTION

Printing systems incorporating a gas flow are known, see, for example, U.S. Pat. No. 4,068,241, issued to Yamada, on Jan. 10, 1978.

The device that provides gas flow to the gas flow drop interaction area can introduce turbulence in the gas flow that may augment and ultimately interfere with accurate drop deflection or divergence. Turbulent flow introduced from the gas supply typically increases or grows as the gas flow moves through the structure or plenum used to carry the gas flow to the gas flow drop interaction area of the printing system.

Drop deflection or divergence can be affected when turbulence, the randomly fluctuating motion of a fluid, is present in, for example, the interaction area of the drops that are traveling along a path and the gas flow force. The effect of turbulence on the drops can vary depending on the size of the drops. For example, when relatively small volume drops are caused to deflect or diverge from the path by the gas flow force, turbulence can randomly disorient small volume drops resulting in reduced drop deflection or divergence accuracy which, in turn, can lead to reduced drop placement accuracy.

Accordingly, a need exists to reduce turbulent gas flow in the gas flow drop interaction area of a printing system.

SUMMARY OF THE INVENTION

According to one aspect of the present invention, a gas flow device includes a passage for a gas including a wall. A gas flow source is operable to cause the gas to flow in a direction through the passage. A liquid flow source operable to cause a liquid to flow in a direction along the wall of the passage, and the flow direction of the liquid is in the same direction as that of the gas flow.

According to another aspect of the present invention, a printing system includes a liquid drop ejector operable to eject liquid drops having a plurality of volumes along a first path and a passage for a gas including a wall. A gas flow source is operable to cause the gas to flow in a direction through the passage. A liquid flow source operable to cause a liquid to flow in a direction along the wall of the passage, and the flow direction of the liquid is in the same direction as that of the gas flow. Interaction of the gas flow and the liquid drops causes liquids drops having one of the plurality of volumes to begin moving along a second path.

According to another aspect of the present invention, a method of moving gas includes providing a passage including a wall; providing a gas flow from a gas flow source, the gas moving in a direction through the passage; and moving the wall along a travel path in the same direction as that of the gas flow. A liquid flow source operable to cause a liquid to flow in a direction along the moving wall of the passage, and the flow direction of the liquid is in the same direction as that of the gas flow.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
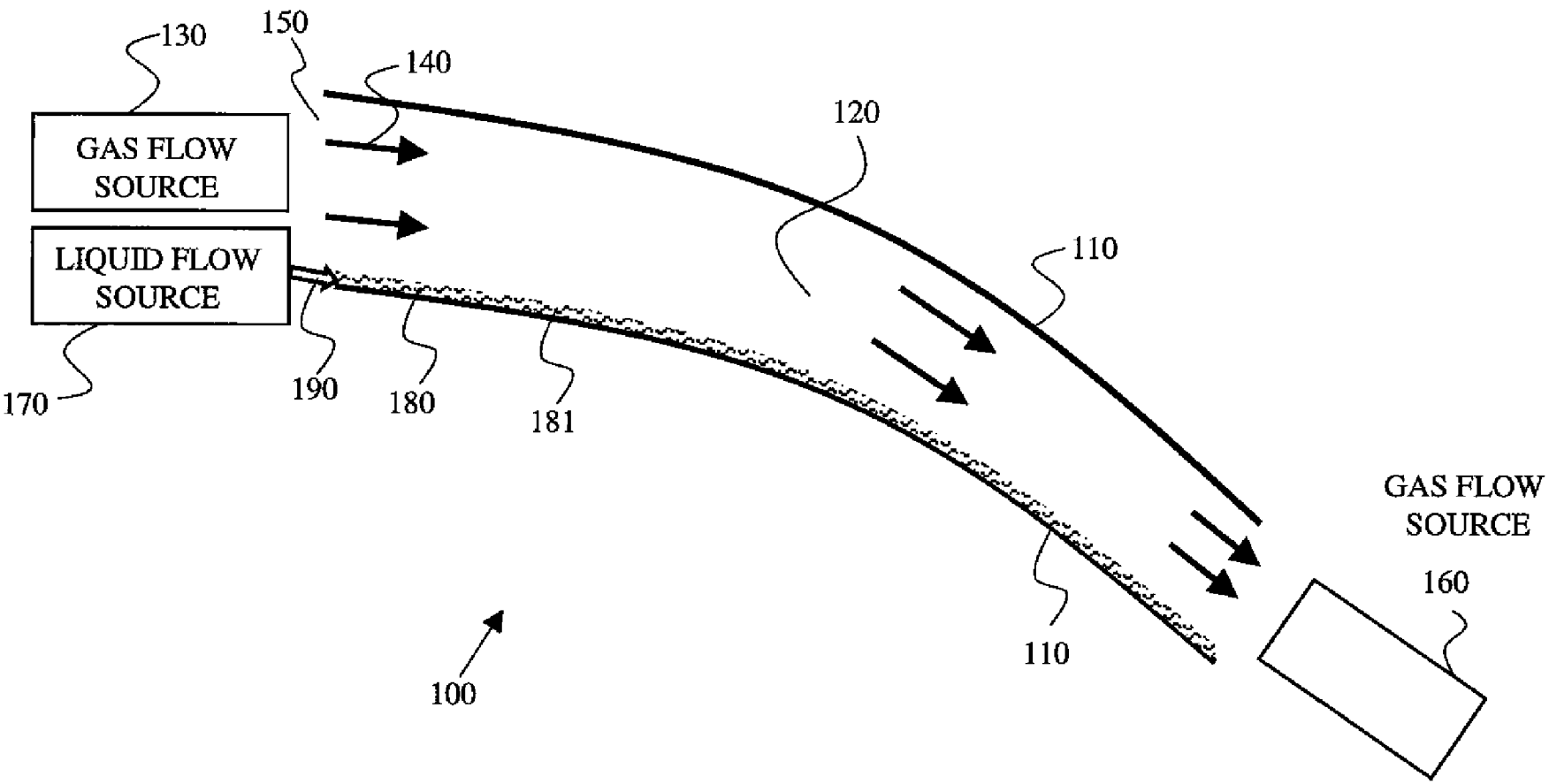
FIG. 1 is a schematic side view of an example embodiment of the present invention.

The present description will be directed in particular to elements forming part of, or cooperating more directly with, apparatus in accordance with the present invention. It is to be understood that elements not specifically shown or described may take various forms well known to those skilled in the art. The example embodiments of the present invention are illustrated schematically and not to scale for the sake of clarity. One of ordinary skill in the art will be able to readily determine the specific size and interconnections of the elements of the example embodiments of the present invention. In the following description, identical reference numerals have been used, where possible, to designate identical elements.

Although the term printing system is used herein, it is recognized that printing systems are being used today to eject other types of liquids and not just ink. For example, the ejection of various fluids such as medicines, inks, pigments, dyes, and other materials is possible today using printing systems. As such, the term printing system is not intended to be limited to just systems that eject ink.

When present in printing systems, for example, like those commonly referred to as continuous printing systems, turbulence, particularly wall-turbulence in the drop deflector system, is induced mainly by boundary friction (drag on the gas flow, for example, air, exerted by the walls of the deflector system). Drag and therefore turbulence can be reduced or even eliminated by actively controlling the boundary regions of the system. Boundary regions include, for example, areas of the system where the gas flow is adjacent to a solid portion, for example, a wall, of the system.

Drag reduction is accompanied by reductions in the magnitude of shear stress, commonly referred to as Reynolds shear stress, throughout the gas flow. This also helps to reduce or even eliminate turbulence. For example, when a liquid, moving along a boundary region, is moving in the same direction and at substantially the same velocity as velocity of the gas flow, drag can be reduced and the gas flow, for example, a laminar gas flow, can be maintained in the drop deflector system. The moving liquid surface decreases or even eliminates the fluid velocity gradient induced by boundary friction. The moving liquid moving on the wall of gas flow passages can also keep the wall free of contaminations such as particles or dry ink. Additionally, the moving liquid traveling along or over the wall of gas flow passage can also keep the temperature of the wall from increasing if heat is generated during wall movement. For example, friction associated with the moving wall may generate heat. In this situation, the addition of the moving liquid may help to keep the moving wall from overheating.

FIG. 1 is a schematic side view of an example embodiment of the present invention. The gas flow device 100 includes a wall or walls 110 that define a passage 120. A gas flow source 130 is operatively associated with the passage 120 and is operable to cause a gas to flow in a direction (represented by arrows 140, hereafter) through the passage 120. Gas flow source 130 can be any type of mechanism commonly used to create a gas flow. For example, gas flow source 130 can be a positive pressured flow source such as a fan or a blower operatively associated with an air front side 150 of the passage 120. Alternatively, gas flow source 130 can be of the type that creates a negative pressure or a vacuum operatively associated with the air back side 160 of the passage 120. Positioning of the gas flow source 130 relative to passage 120 depends on the type of the gas flow source used. For example, when a positive pressure gas flow source 130 is used, gas flow source can be located at the front side of passage 150. When a negative pressure gas flow source 130 is used, the gas flow source can be located at the back side of passage 160.

A liquid flow source 170 is operatively associated with the flow system 100 and is operable to cause a liquid 180 to flow in a direction along a wall 110 of the passage 120, and the flow direction (represented by a hollow arrow 190) of the liquid flow 181 being in the same direction as the direction of the gas flow 140. Liquid flow source 170 can be any type of mechanism suitably used to create the liquid flow 181. For example, liquid flow source 170 can be of the type that creates a positive pressure type liquid flow source such as liquid ejectors or a pump. The liquid flow source 170 can be located at the front side 150 of the passage 120. It is preferred that the velocity of liquid flow 181 be substantially equal to the velocity of the gas flow 140. However, the velocity of liquid flow 181 can be different than the velocity of the gas flow 140 depending on the specific application being contemplated.

The shape of the walls 110 of the passage 120 can be straight or be curved as needed. The walls 110 of the passage 120 can be any suitable materials such as aluminum, stainless steel, plastics, glass etc.; the surfaces of the wall 110 may be coated as necessary with hydrophobic or hydrophilic materials, depending on the type of liquid 180 being used, to facilitate liquid 180 to move along the wall 110. The liquid 180 can be, but not limited to, water or ink, or specifically engineered liquid with specific properties, such as a relative low surface tension coefficient, low viscosity, high thermal conductivity and/or high specific heat capacity. The gas of the gas flow source 130 can be air, vapor, nitrogen, helium, carbon dioxide, etc.

Figure 2:
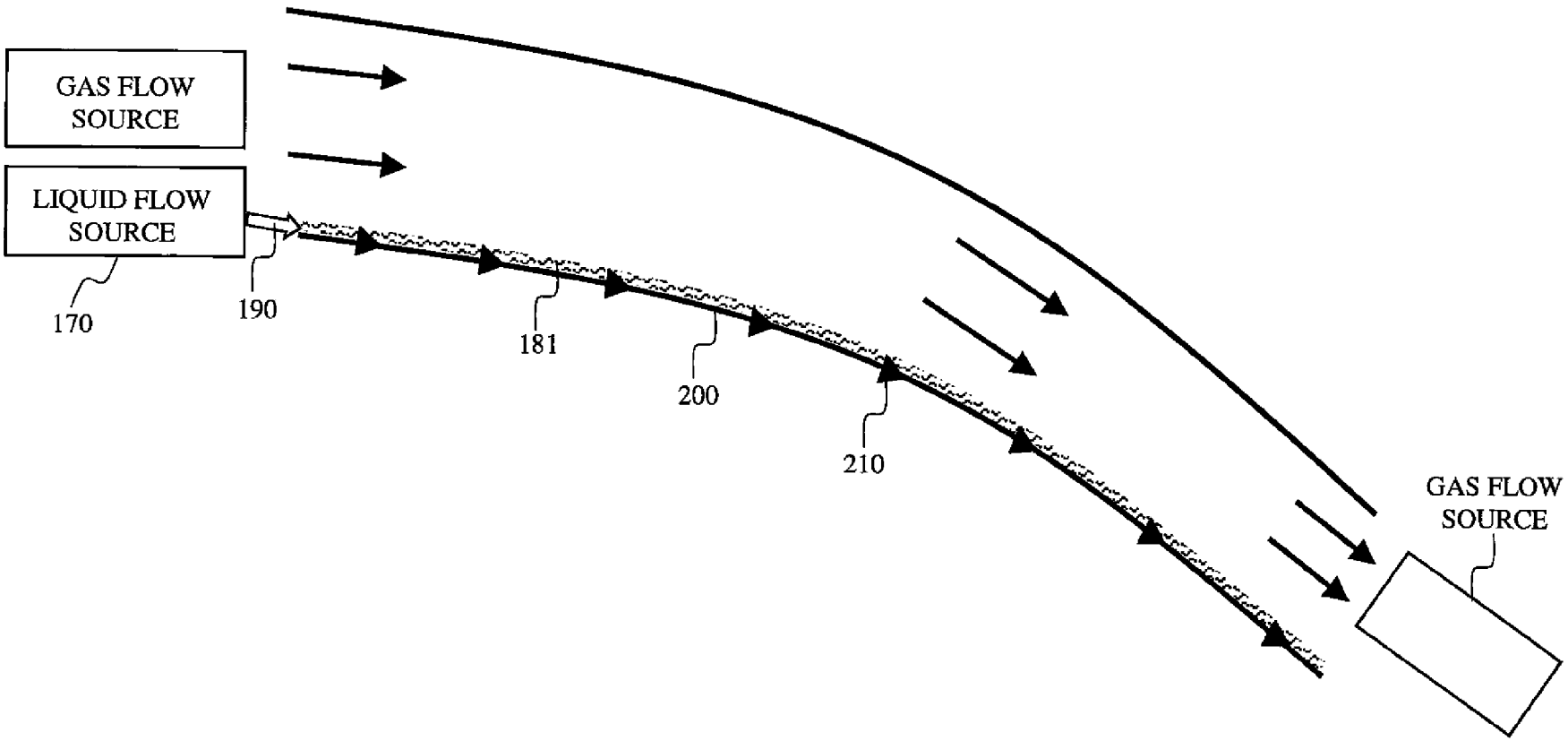
FIG. 2 is a schematic side view of another example embodiment of the present invention.

One wall of the walls of the passage can be static or have a travel path, in the same direction as that of the gas flow. FIG. 2 is a schematic side view of another example embodiment of the present invention, where one wall 200, having a travel path, is moving in the same direction as that of the fluid flow. The moving wall 200 is represented by triangular blocks 210. Movement of the moving wall 200 can be accomplished using any device commonly used for this purpose. Examples of these types of devices are described in copending application Ser. No. 11/746,117. A liquid flow source 170 is operatively associated with the flow system and is operable to cause a liquid flow 181 to flow in a direction on top of and along the moving wall 200 of the passage, and the flow direction (represented by a hollow arrow 190) of the liquid flow 181 being in the same direction as the direction of the gas flow. It is preferred that the combined velocity of liquid flow 181 and the moving wall 200 be substantially equal to the velocity of the gas flow. However, the combined velocity of liquid flow 181 and the moving wall 200 can be different than the velocity of the gas flow depending on the specific application being contemplated. The liquid flow 181 moving on the moving wall 200 of gas flow passages can also keep the moving wall 200 from increasing temperature that may be induced by friction.

Figure 3:
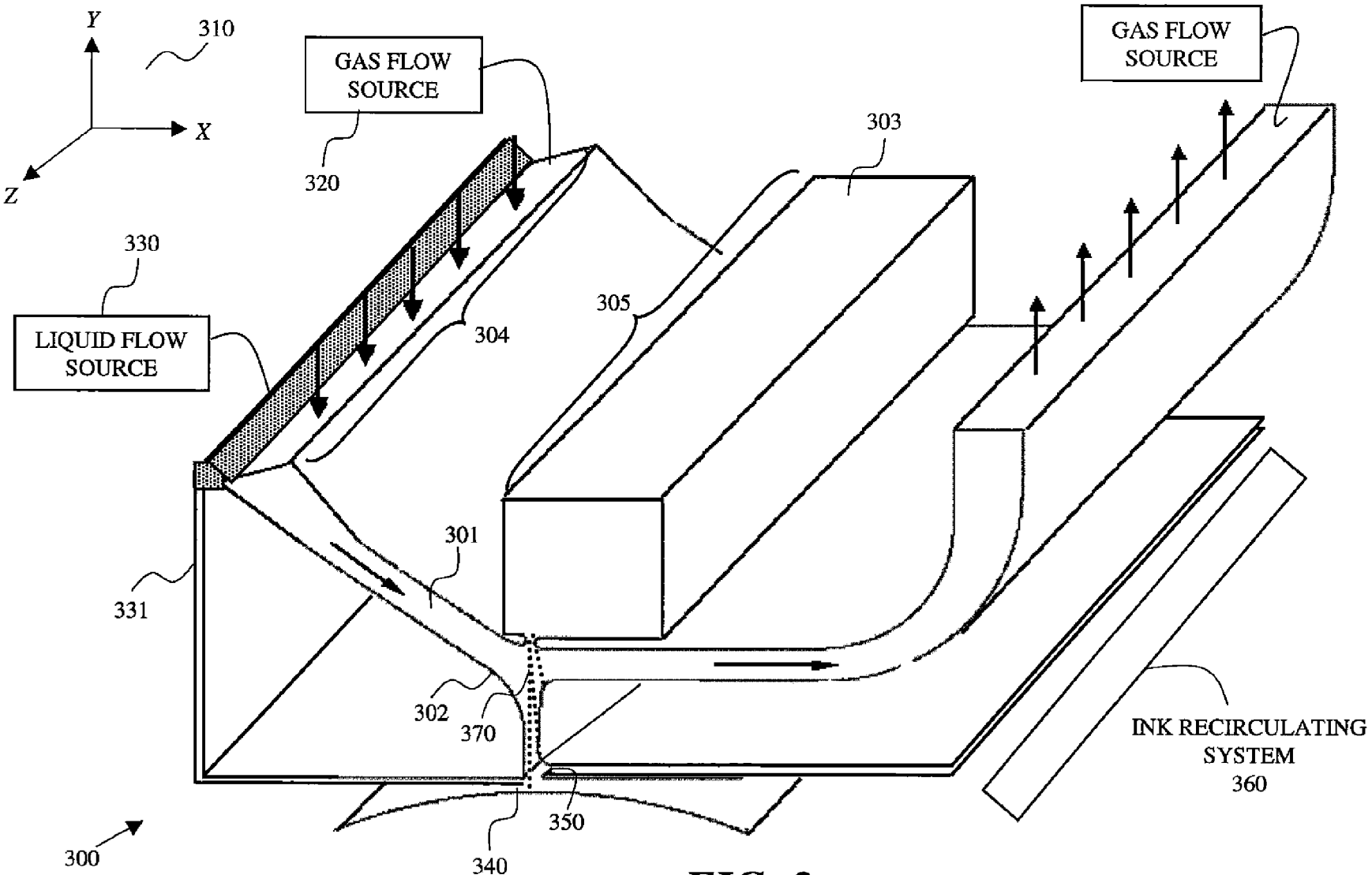
FIG. 3 is a schematic three-dimensional view of an example printing system embodiment of the present invention.

Referring to FIG. 3, a three-dimensional schematic view of a printing system 300 incorporating an example embodiment of the gas flow device 301 and the liquid moving surface device 302 is shown. A Cartesian coordinate system x-y-z 310 is also included in FIG. 3 to show the relative orientations of the cross sections described in figures hereafter. A gas flow source 320 is operatively associated with the gas flow device 301 and is operable to cause a gas to flow. A liquid flow source 330 is operatively associated with the gas flow system 301 and is operable to cause a liquid to flow in a direction along the liquid moving surface device 302. The liquid is circulated through a liquid recirculation mechanism 331, for example, a porous filter. The printing system 300 includes a printhead 303 positioned to eject drops through additional passage of the gas flow device 301.

The printhead 303 includes a drop forming mechanism operable to form drops 370 having a plurality of volumes traveling along a first path. A drop deflector system including gas flow device 301 applies a gas flow force to the drops traveling along the first path. The gas flow force is applied in a direction such that drops having one of the plurality of volumes diverge (or deflect) from the first path and begin traveling along a second path while drops having another of the plurality of volumes remain traveling substantially along the first path or diverge (deflect) slightly and begin traveling along a third path. Receiver 340 is positioned along one of the first, second and third paths while a catcher 350 is positioned along another of the first, second or third paths depending on the specific application contemplated. Printheads like printhead 303 are known and have been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; and U.S. Pat. No. 6,588,888 B2, issued to Jeanmaire et al., on Jul. 8, 2003.

At least some of the ejected drops contact a receiver 340, such as paper or other media, while other drops are collected by a mechanism such as a catcher 350. Ink received by the catcher 350 is circulated through an ink recirculation mechanism 360 for reusing. Typically, the width 304 of the gas flow device 301 is wider than the length 305 of the nozzle array of the printhead 303 which helps to reduce or eliminate the boundary effects described above. However, passage width 304 that is equal to, or less than the length 305 of the nozzle array of the printhead 303 is permitted.

Figure 4A:
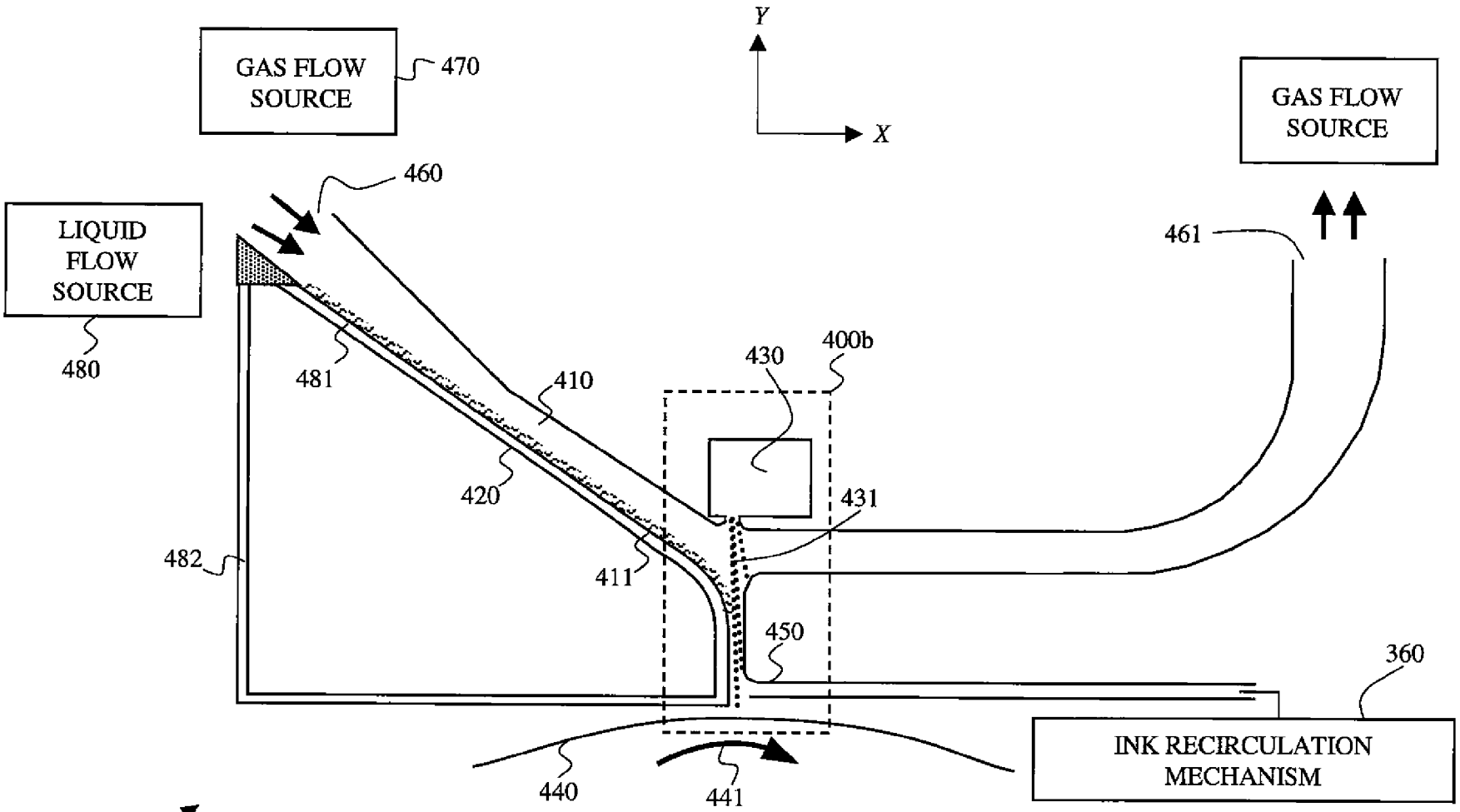
FIG. 4A is a schematic two-dimensional side view of an example printing system embodiment of the present invention.

Referring to FIG. 4A, a schematic side view of the printing system 400 incorporating the example embodiment of the gas flow device 410 and the liquid moving surface device 420 is shown. The printing system 400 includes a printhead 430 positioned to eject drops through additional passage of the gas flow device 410. At least some the drops contact a receiver 440, such as paper or other media, while other drops are collected by a circulation mechanism, such as a catcher 450. The media is moving/rotating in a direction indicated by the arrow 441. Liquid received by the catcher 450 is circulated through a liquid recirculation mechanism, such as a porous filter. After being ejected by the drop forming mechanism of printhead 430, drops 431 travel along the first path which is substantially perpendicular to printhead. Gas flow device 410 of the drop deflector system is positioned at an angle with respect to the path of ejected drops. Gas flow device includes an inlet portion 460 and an outlet portion 461 located on either side of the travel path. A gas flow source 470 is operatively associated with one or both of the inlet portion 460 and the outlet portion 461. For example, pressurized gas, for example, air, from a pump can be introduced in the inlet portion 460 and/or a vacuum (negative air pressure relative to ambient operating conditions) from a vacuum pump can be introduced in the outlet portion 461. The gas flow of the drop deflector interacts with ejected drops and causes drops to diverge or deflect as described above. The amount of deflection is volume dependent with smaller volume drops being deflected by gas flow more than larger volume drops.

Any one of or all of walls 411 of gas flow device 410 can have a travel path, and can be moveable in the example embodiment shown in FIG. 4A and can be covered by moving liquid flow 481. However, in the configuration shown in FIG. 4A, typically, one of or both of walls and/or are made static but covered by moving liquid. A liquid flow source 480 is operatively associated with the inlet portion 460 of gas flow passage 410. Liquid, for example, ink from an ejector or water from a pump can be introduced in the inlet portion 460 along a wall 411 of the passage. The liquid ejected from the liquid source 480 moves along the wall with the same direction as that of the gas flow. It is preferred that the velocity of liquid flow 481 be substantially equal to the velocity of the gas flow. However, the velocity of liquid flow 481 can be different than the velocity of the gas flow depending on the specific application being contemplated. A liquid recirculation mechanism 482 is devised to recycle the liquid back to the liquid flow source 480 for reuse.

Figure 4B:
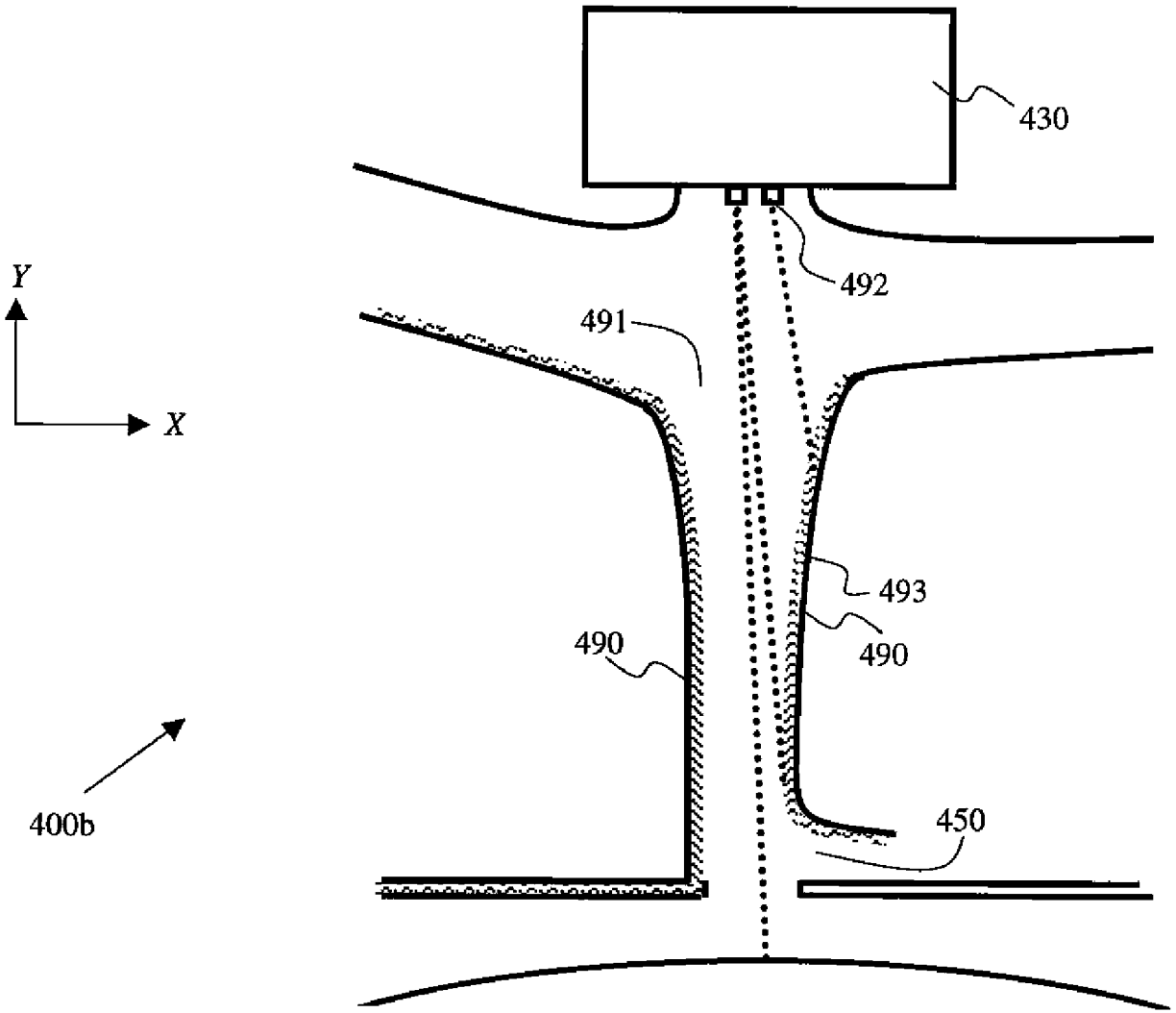
FIG. 4B is a close-up schematic of the deflection area of an example printing system embodiment of the present invention; and, FIG. 5 is a schematic two-dimensional side view of another example embodiment of the present invention.

FIG. 4B shows a local close-up of a portion 400b of the gas flow passage in FIG. 4A for clarity presentation of the example embodiment of liquid moving walls 490. A liquid flow source 492 is operatively associated with the up-portion 491of gas flow passage. The liquid flow source 492 can be, for example, pumped ink from an ejector. The liquid ejected from the liquid source 492 moves along the wall 490 of the passage to form liquid flow 493 with the same direction as that of the gas flow towards the media. It is preferred that the velocity of liquid flow 493 be substantially equal to the velocity of the gas flow 494 towards the media. However, the velocity of liquid flow 493 can be different from the velocity of the gas flow 494 depending on the specific application being contemplated. The liquid, typical is ink will be circulated through the gutter 450, and sent back to ink tank for reuse by an ink recirculation mechanism for clearing up some particles that may be introduced during the process. The moving liquid moves in the same direction as that of the gas flow and, preferably, at substantially the same velocity as that of the gas flow. Typically, the width of moving liquid surface is as wide as the gas flow passage. However, the liquid surface(s) widths that are equal to or less than the width of the gas flow passage are permitted.

Figure 5:
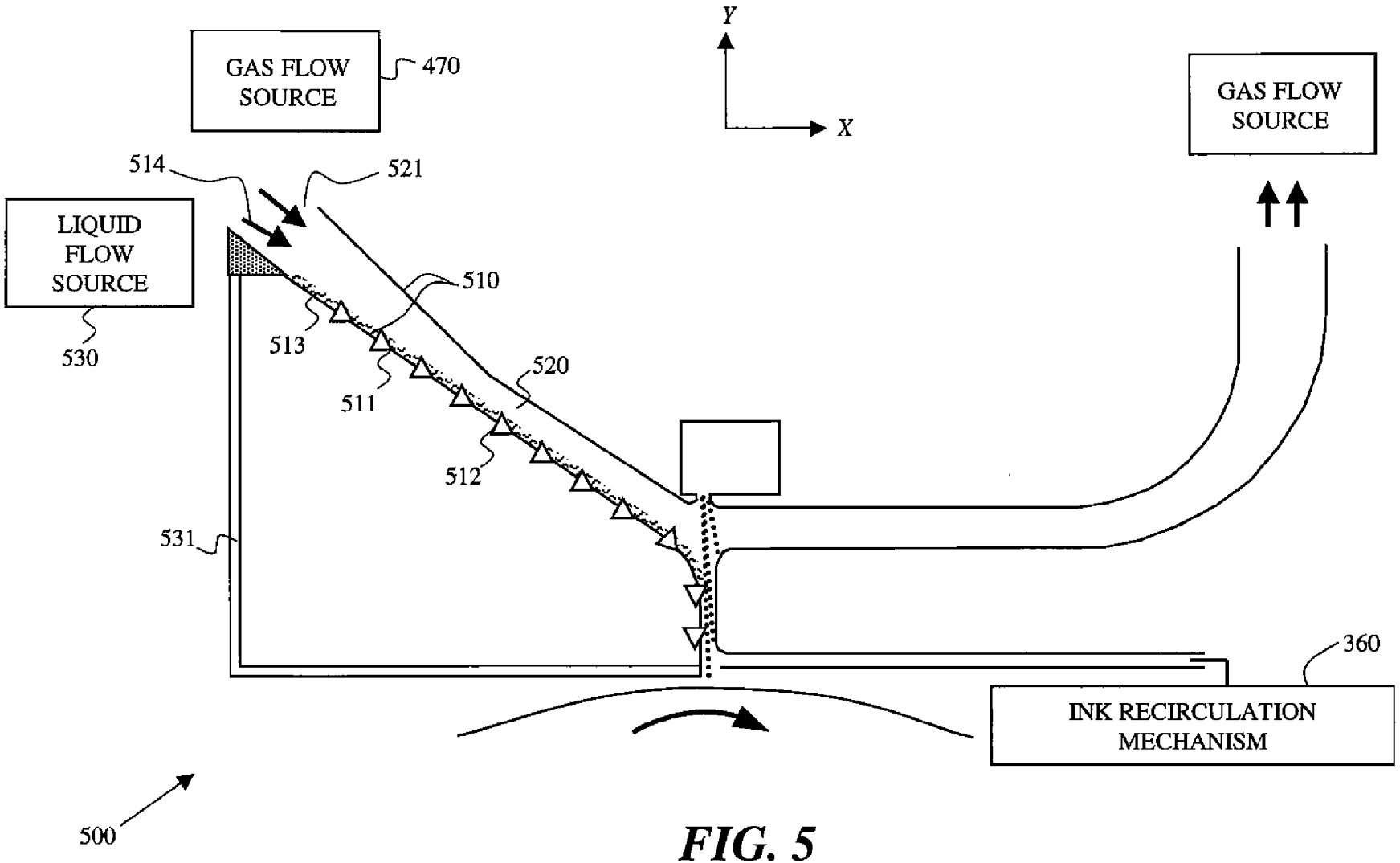

Referring to FIG. 5, a schematic side view of another printing system 500 incorporating an example embodiment of the fluid flow device 520 is shown. At least one or all of walls 510 of gas flow device 520 have a travel path, and can be moveable in the example embodiment shown in FIG. 5. The other elements of the embodiment of printing system shown in the figure are the same as the corresponding elements of the embodiments of printing system shown in FIG. 4A. A moving wall 511 is represented by triangular blocks 512. Movement of the moving wall 511 can be accomplished using any device commonly used for this purpose. Examples of these types of devices are described in copending U.S. patent application Ser. No. 11/746,117.

The moving wall 511 in the inlet potion 521 of the gas flow passage moves in the direction the same as that of the gas flow. A liquid flow source 530 is operatively associated with the inlet portion 521 of gas flow passage. Liquid such as pumped water or ink from an ejector, for example, can be introduced from the inlet portion 521of the gas passage. The liquid 513 ejected from the liquid source 530 moves on and along the moving wall 511 of the passage with the same direction as that of the gas flow. It is preferred that the combined velocity of liquid 513 and the moving wall 511 be substantially equal to the velocity of the gas flow 514. However, the combined velocity of liquid 513 and the moving wall 511 can be different than the velocity of the gas flow depending on the specific application being contemplated. A liquid recirculation mechanism 531 is devised to circulate the liquid back to the liquid flow source 530 for reuse. Typically, the width of passage is wider than the length of the nozzle array of printhead which helps to reduce or eliminate the boundary effects. However, passage widths that are equal to of less than the length of the nozzle array of printhead are permitted. The liquid 513 can be, but not limited to, water or ink, or specifically engineered liquid with specific properties, such as a relative low surface tension coefficient, low viscosity, high thermal conductivity and/or high specific heat capacity. The surface of the moving wall 511 can be coated with hydrophobic or hydrophilic materials, depending on the type of liquid 513 being used, to facilitate liquid 513 to move along the moving wall 511.

Referring back to the figures, the present invention can be used to accomplish other printing system functions. For example, the liquid flow can be used to clean one or more portions of the printing system. The liquid flow can be used to clean the wall of the passage. Optionally, the liquid can be recirculated and filtered after it has traveled along the passage wall. Additionally, the catcher mechanism of the printing system can be cleaned using the liquid or a second liquid provided from a second liquid source, for example, one or more of the printhead nozzles, that is caused to flow along a wall of the catcher mechanism in a direction substantially toward an inlet of the catcher mechanism.

The invention has been described in detail with particular reference to certain preferred embodiments thereof, but it will be understood that variations and modifications can be effected within the scope of the invention.

PARTS LIST

100 gas flow device
110 walls
120 passage
130 gas flow source
140 arrows
150 air front side
160 air back side
170 liquid flow source
180 liquid
181 liquid flow

190 hollow arrow
200 where one wall
210 triangular blocks
300 printing system
301 gas flow device
302 liquid moving surface device
303 printhead
304 width
305 length
310 Cartesian coordinate system x-y-z
320 gas flow source
330 liquid flow source
331 liquid recirculation mechanism
340 receiver
350 catcher
360 ink recirculation mechanism
370 drops
400 printing system
**400*b*** portion
410 gas flow device
411 walls
420 liquid moving surface device
430 printhead
431 drops
440 receiver
441 arrow
450 catcher
460 inlet portion
461 outlet portion
470 gas flow source
480 liquid flow source
481 moving liquid flow
482 liquid recirculation mechanism
490 liquid moving walls
491 passage portion
492 liquid flow source
493 liquid flow
494 gas flow
500 printing system
510 walls
511 moving wall
512 triangular blocks
513 liquid
514 gas flow
520 fluid flow device
521 inlet portion
530 liquid flow source
531 liquid recirculation mechanism

The invention claimed is:

1. A printing system comprising:

a liquid drop ejector operable to eject liquid drops having a plurality of volumes along a first path;

a positive pressure gas flow passage including a wall;

a positive pressure gas flow source operable to provide a positive pressure gas flow in a direction through the positive pressure gas flow passage; and a liquid flow source operable to cause a liquid to flow in a direction along the wall of the positive pressure gas flow passage, the flow direction of the liquid being in the same direction as that of the gas flow, wherein interaction of the gas flow and the liquid drops causes liquids drops having one of the plurality of volumes to begin moving along a second path.

2. The system of claim 1, wherein the direction of gas flow and liquid flow is non-perpendicular relative to the first path.

3. The system of claim 1, the liquid flow having a velocity, the gas flow having a velocity, wherein the velocity of the liquid flow is substantially equal to the velocity of the gas flow.

4. The system of claim 1, wherein the liquid is an ink.

5. The system of claim 1, further comprising:

a recirculation system operable to recirculate the liquid back to the liquid flow source.

6. The system of claim 1, further comprising:

a catcher shaped to collect the liquid drops having one of the plurality of volumes moving along the second path.

7. A printing system comprising:

a liquid drop ejector operable to eject liquid drops having a plurality of volumes alone a first path;

a passage including a wall;

a gas flow source operable to cause a gas to flow in a direction through the passage; and a liquid flow source operable to cause a liquid to flow in a direction along the wall of the passage, the flow direction of the liquid being in the same direction as that of the gas flow, wherein interaction of the gas flow and the liquid drops causes liquids drops having one of the plurality of volumes to begin moving along a second path, and wherein the wall of the passage includes a portion moveable in the same direction as that of the liquid flow.

8. A printing system comprising:

a liquid drop ejector operable to eject liquid drops having a plurality of volumes along a first path;

a passage including a wall;

a gas flow source operable to cause a gas to flow in a direction through the passage such that interaction of the gas flow and the liquid drops causes liquids drops having one of the plurality of volumes to begin moving along a second path;

a liquid flow source operable to cause a liquid to flow in a direction along the wall of the passage, the flow direction of the liquid being in the same direction as that of the gas flow;

a catcher mechanism positioned in one of the first path and the second path, the catcher mechanism including a wall and an inlet; and a second liquid flow source operable to cause a second liquid to flow along the wall of the catcher mechanism in a direction substantially toward the inlet of the catcher mechanism.

9. The system of claim 8, wherein the second liquid is an ink.

10. The system of claim 8, wherein the second liquid flow source is an ejector and the second liquid is an ink pumped from the ejector.

11. A method of printing comprising:

providing liquid drops having a plurality of volumes traveling along a first path;

providing a positive pressure gas flow passage including a wall;

causing a positive pressure gas to flow in a direction through the passage;

causing a liquid to flow in a direction along the wall of the positive pressure gas flow passage, the flow direction of the liquid being in the same direction as that of the gas; and causing liquid drops having one of the plurality of volumes to begin moving along a second path through interaction of the gas flow and the liquid drops.

12. The method of claim 11, further comprising:

recirculating the liquid.

13. The method of claim 12, wherein recirculating the liquid includes filtering the liquid.

14. The method of claim 11, the gas flow having a velocity, wherein causing the liquid to flow in the direction along the wall of the passage includes causing the liquid to flow at a velocity that is substantially equal to the velocity of the gas flow.

15. The method of claim 11, further comprising:

providing a catcher; and using the catcher to collect the liquid drops having one of the plurality of volumes.

16. A method of printing comprising:

providing liquid drops having a plurality of volumes traveling along a first path;

providing a passage including a wall;

causing a gas to flow in a direction through the passage;

causing a liquid to flow in a direction along the wall of the passage, the flow direction of the liquid being in the same direction as that of the gas;

causing liquid drops having one of the plurality of volumes to begin moving along a second path through interaction of the gas flow and the liquid drops providing a catcher mechanism positioned in one of the first path and the second path, the catcher mechanism including a wall and an inlet; and providing a second liquid flow source operable to cause a second liquid to flow along the wall of the catcher mechanism in a direction substantially toward the inlet of the catcher mechanism.

17. A method of cleaning a printing system comprising:

providing a printhead;

providing a positive pressure gas flow passage including a wall, the positive pressure gas flow passage being associated with the printhead;

causing a positive pressure gas to flow in a direction through the passage; and cleaning the wall of the positive pressure gas flow passage by causing a liquid to flow in a direction along the wall of the positive pressure gas flow passage, the flow direction of the liquid being in the same direction as that of the gas.

18. The method of claim 17, further comprising:

recirculating the liquid.

19. The method of claim 18, wherein recirculating the liquid includes filtering the liquid.

20. The method of claim 17, the wall of the passage being moveable, the method further comprising:

causing the wall of the passage to move in the same direction as that of the liquid flow.

21. A method of cleaning a printing system comprising:

providing a printhead;

providing a passage including a wall, the passage being associated with the printhead;

causing a gas to flow in a direction through the passage;

cleaning the wall of the passage by causing a liquid to flow in a direction along the wall of the passage, the flow direction of the liquid being in the same direction as tat of the gas;

providing a catcher mechanism positioned in one of the first path and the second path, the catcher mechanism including a wall and an inlet;

providing a second liquid flow source; and cleaning the wall of the catcher mechanism by causing a second liquid from the second liquid source to flow along the wall of the catcher mechanism in a direction substantially toward the inlet of the catcher mechanism.

22. A method of printing comprising:

providing liquid drops having a plurality of volumes traveling along a first path;

providing a passage including a wall;

causing a gas to flow in a direction through the passage;

causing a liquid to flow in a direction along the wall of the passage, the flow direction of the liquid being in the same direction as that of the gas;

causing liquid drops having one of the plurality of volumes to begin moving along a second path through interaction of the gas flow and the liquid drops;

providing a portion of the wall that is moveable in the same direction as that of the gas flow; and causing the moveable portion of the wall to move in the same direction as that of the gas flow.

23. The method of claim 22, the gas flow having a velocity, the moveable portion of the wall having a velocity when the moveable portion of the wall is moving, wherein causing the liquid to flow in the direction along the wall of the passage includes causing the liquid to flow at a velocity that when combined with the velocity of the moving wall is substantially equal to the velocity of the gas flow.

24. A printing system comprising:

a liquid drop ejector operable to eject liquid drops having a plurality of volumes along a first path;

a passage;

a gas flow source operable to cause a gas to flow in a direction through the passage such that interaction of the gas flow and the liquid drops causes liquids drops having one of the plurality of volumes to begin moving along a second path;

a catcher mechanism positioned in one of the first path and the second path, the catcher mechanism including a wall and an inlet; and a second liquid flow source operable to cause a second liquid to flow along the wall of the catcher mechanism in a direction substantially toward the inlet of the catcher mechanism.

25. The system of claim 24, wherein the second liquid is an ink.

26. The system of claim 24, wherein the second liquid flow source is an ejector and the second liquid is an ink pumped from the ejector.

27. A method of printing comprising:

providing a liquid drop ejector that ejects liquid drops having a plurality of volumes traveling along a first path;

providing a passage;

causing a gas to flow in a direction through the passage and interact with the liquid drops having the plurality of volumes such that liquid drops having one of the plurality of volumes begin moving along a second path;

providing a catcher mechanism positioned in one of the first path and the second path, the catcher mechanism including a wall and an inlet;

providing a second liquid flow source; and causing a second liquid emitted from the second liquid flow source to flow along the wall of the catcher mechanism in a direction substantially toward the inlet of the catcher mechanism.

* * * * *